United States Patent [19]

Seiriki

[11] Patent Number: 5,020,652

[45] Date of Patent: Jun. 4, 1991

[54] ARTICLE DISPENSING APPARATUS HAVING INTEGRAL COIN RECEIVING CASE AND ARTICLE DISCHARGE MECHANISM

[76] Inventor: Ryohei Seiriki, 2107, Tochi-3-chome, Minato-ku, Nagoya, Japan

[21] Appl. No.: 319,569

[22] Filed: Mar. 6, 1989

[30] Foreign Application Priority Data

Mar. 15, 1988 [JP] Japan ..... 63-34244[U]

[51] Int. Cl.[5] ..... G07F 5/04; G07F 11/22

[52] U.S. Cl. ..... 194/229; 194/299

[58] Field of Search ..... 194/229, 237, 238, 290, 194/291, 292, 293, 294, 295, 298, 299, 300, 250, 251, 252

[56] References Cited

U.S. PATENT DOCUMENTS

| | | | |
|---|---|---|---|
| 395,215 | 12/1888 | Davies et al. | 194/298 X |
| 911,091 | 2/1909 | Thexton | 194/299 |
| 1,662,919 | 3/1928 | Harwood | 194/298 |

FOREIGN PATENT DOCUMENTS

| | | | |
|---|---|---|---|
| 0455293 | 7/1913 | France | 194/229 |

*Primary Examiner*—F. J. Bartuska

*Attorney, Agent, or Firm*—Ladas & Parry

[57] ABSTRACT

An article-dispensing apparatus has a main body including a stacking chamber for receiving articles stacked therein. A rotatable coin receiving case is coupled to a discharge bar for discharging the lowermost article in the stacking chamber. A supporting plate supports the lowermost coin received in the coin case and a push button presses the uppermost coin received in the coin case to rotate the case and dispense the article.

3 Claims, 4 Drawing Sheets

ARTICLE DISPENSING APPARATUS HAVING INTEGRAL COIN RECEIVING CASE AND ARTICLE DISCHARGE MECHANISM

BACKGROUND OF THE INVENTION

The present invention relates to a compact automatic vending machine with a simple structure which can be provided at a low cost, and particularly to an automatic vending machine for small-sized light articles such as contraceptive appliances and the like.

Various types of automatic vending machines have been known which serve as labor saving machines that allow articles to be automatically sold when appropriate coins are deposited therein. Conventional automatic vending machines, however, comprise, so called, a coin selector for checking whether the coins deposited are genuine and, if the coins in question are general currency, discriminating the types of coin and counting the amount of money deposited, and an article discharge mechanism for dispensing the article to be sold, these two apparatuses being separately provided.

Such automatic vending machines must, therefore, have an arrangement in which a large-sized expensive coin selector having a pre-determined size and an article discharge mechanism having a complicated structure are separately incorporated. The structure thus becomes complex and cannot be made compact, and the cost is inevitably high. After such automatic vending machines have been repeatedly used for a long time, they no longer can function smoothly and thus various sorts of troubles and malfunctioning frequently occur, as well as repair being difficult.

SUMMARY OF THE INVENTION

Accordingly, it is an object of the present invention to provide a compact automatic vending machine with a very simple structure which eliminates the risk of malfunctioning of the machine and the possibility of attempts to tamper with the machine.

The automatic vending machine of the present invention comprises a coin receiving case which is pivotally provided in a box-like shaped body through a spring so as to be rotatable; a discharge bar which is so provided as to extend downwardly from the receiving case for the purpose of discharging the lowermost article in an article stacking storage chamber; an opening portion which is provided at the upper end of the receiving case for the purpose of receiving coins; the opening portion being placed below a slot and a projection being provided at a position located on the front side of the receiving case and below the opening portion; a supporting plate for supporting the lowermost coin of a given number of coins received in the receiving case; and a push button which has a projecting plate and a pushing plate respectively engageable with the uppermost coin of a given number of coins received in the receiving case and the projection and which is provided on the body through a spring; so that the lowermost article in the stacking storage chamber is discharged after the coins fall from an opening portion provided at the lower end of the receiving case by pressing the push button so as to enable the projecting plate of the push button to engage with the uppermost coin of the appropriate coins received in the receiving case. The receiving case preferably has a shaft for allowing it to rotate substantially at the center thereof and is forwardly inclined.

DESCRIPTION OF THE PREFERRED EMBODIMENTS

Figure 1:
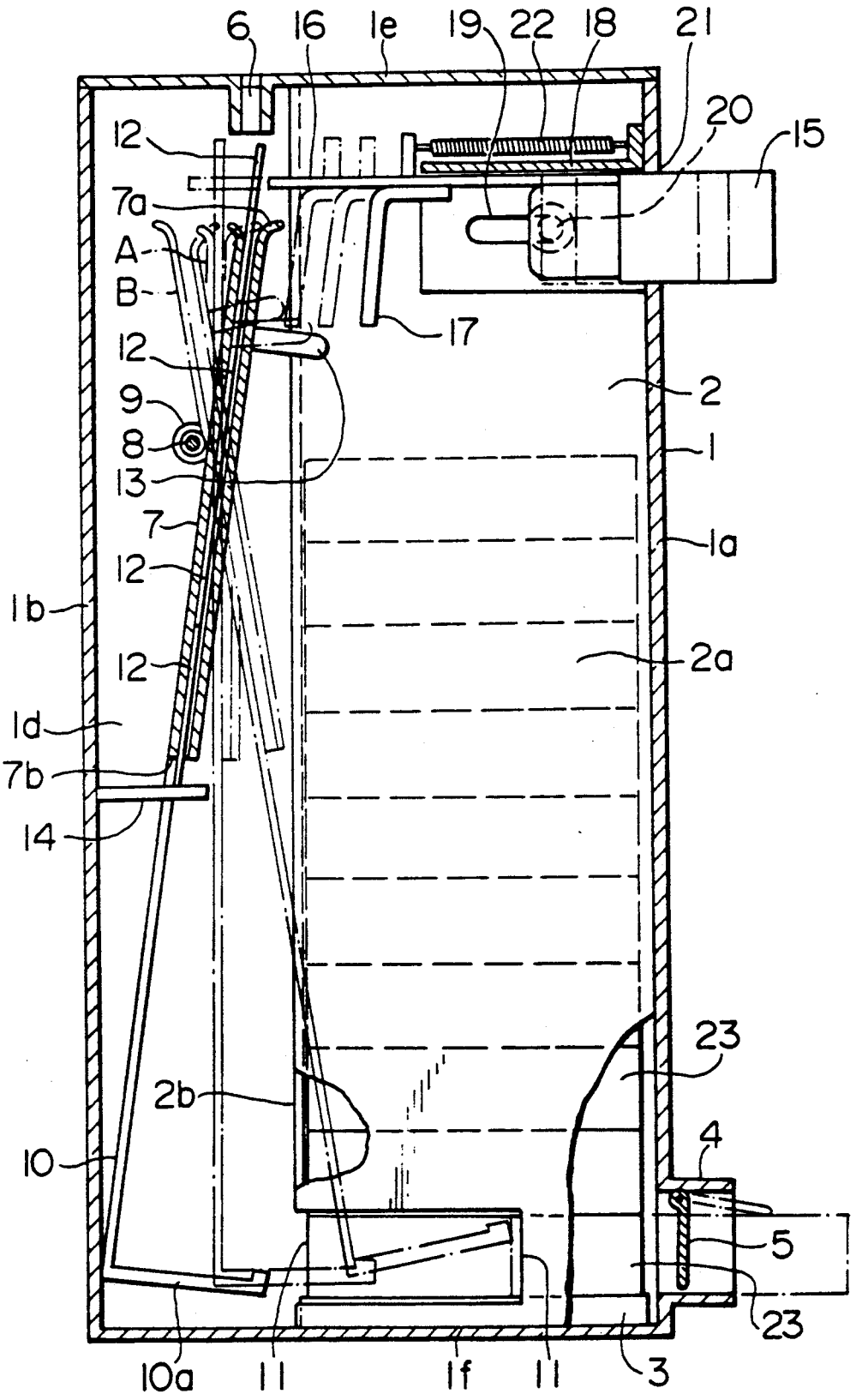
FIG. 1 is a sectional left side view of an automatic vending machine of the present invention.
Figure 2:
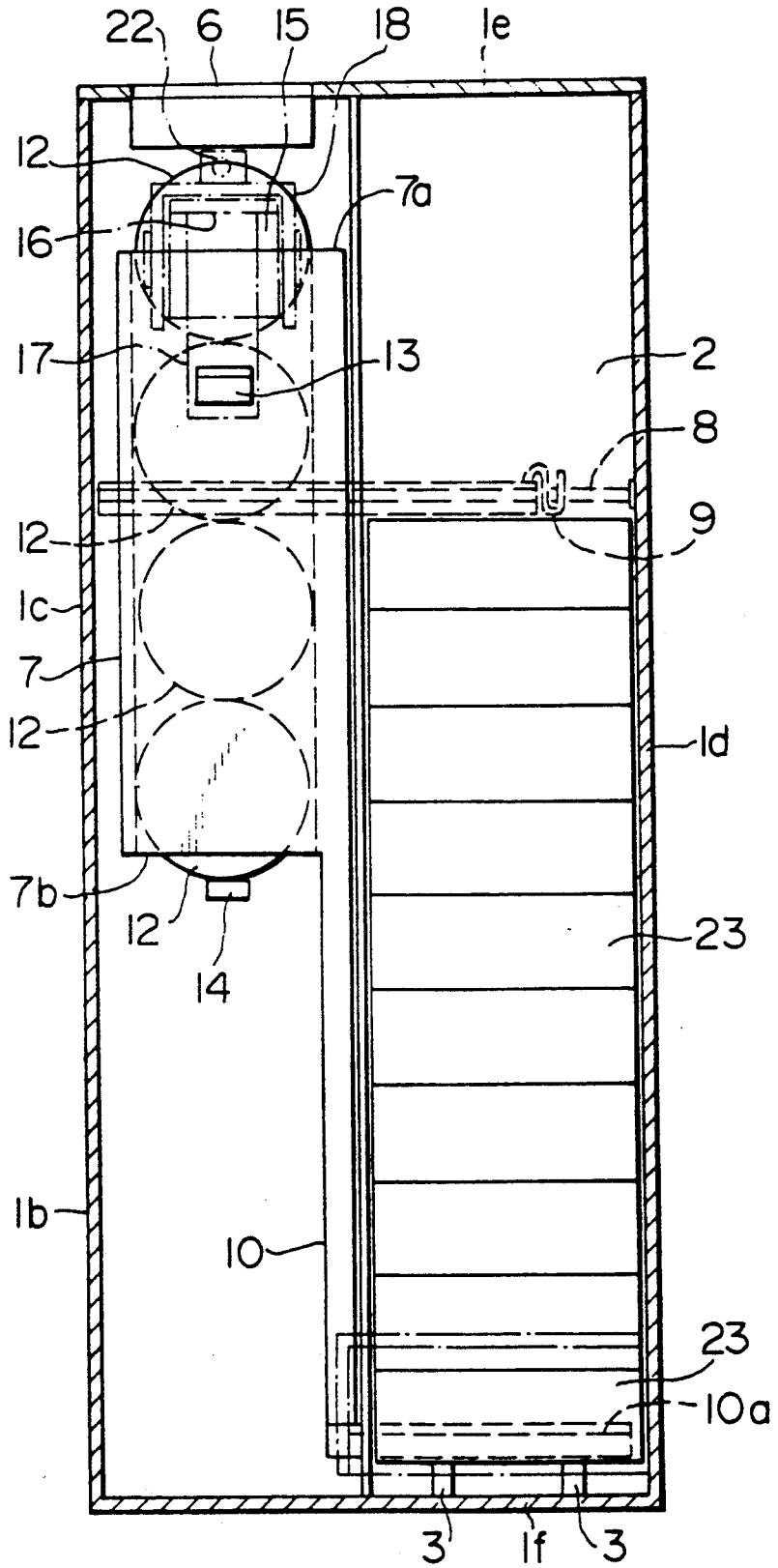
FIG. 2 is a sectional front view of the same.
Figure 3:
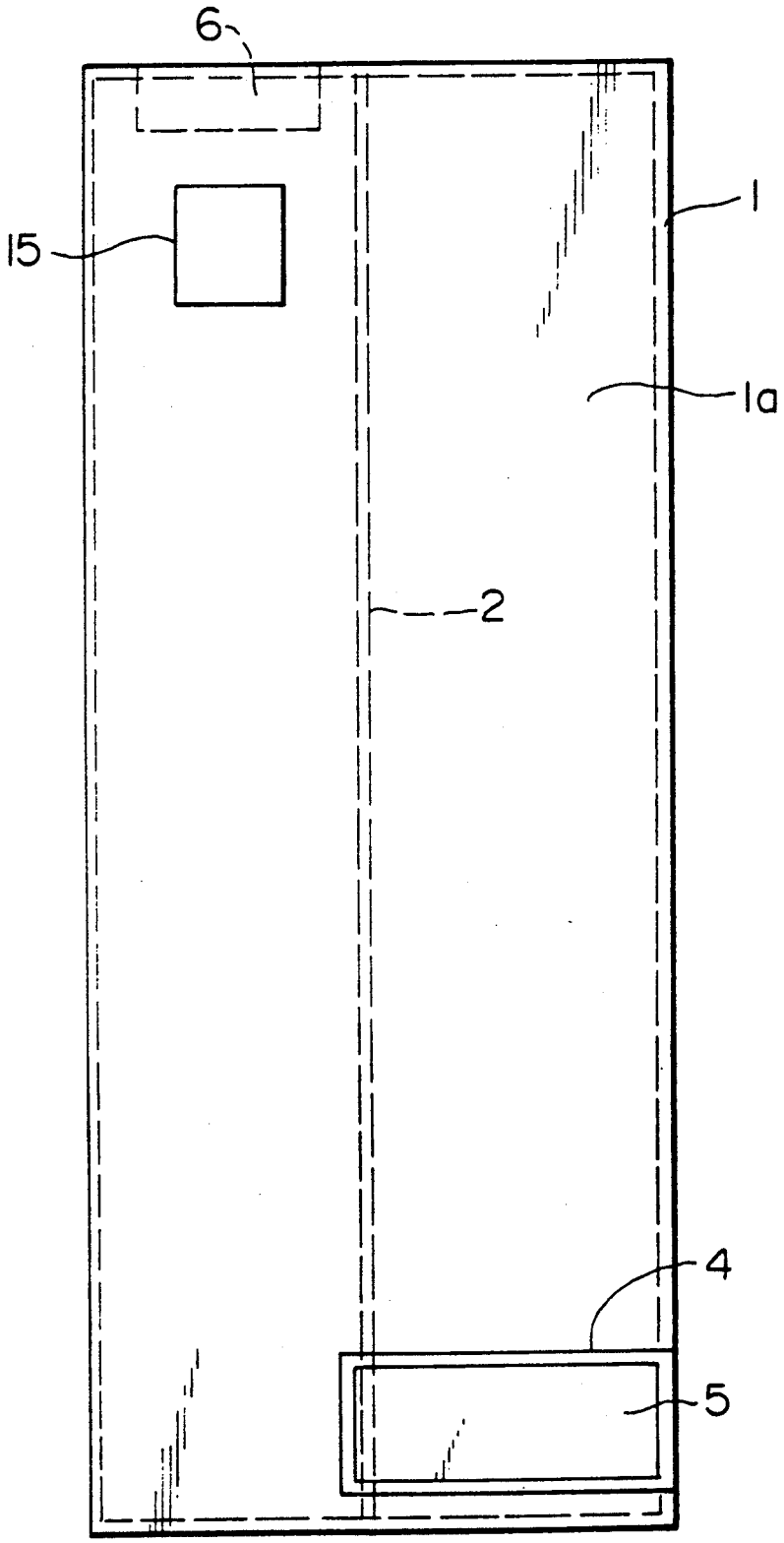
FIG. 3 is a front view of the same.
Figure 4:
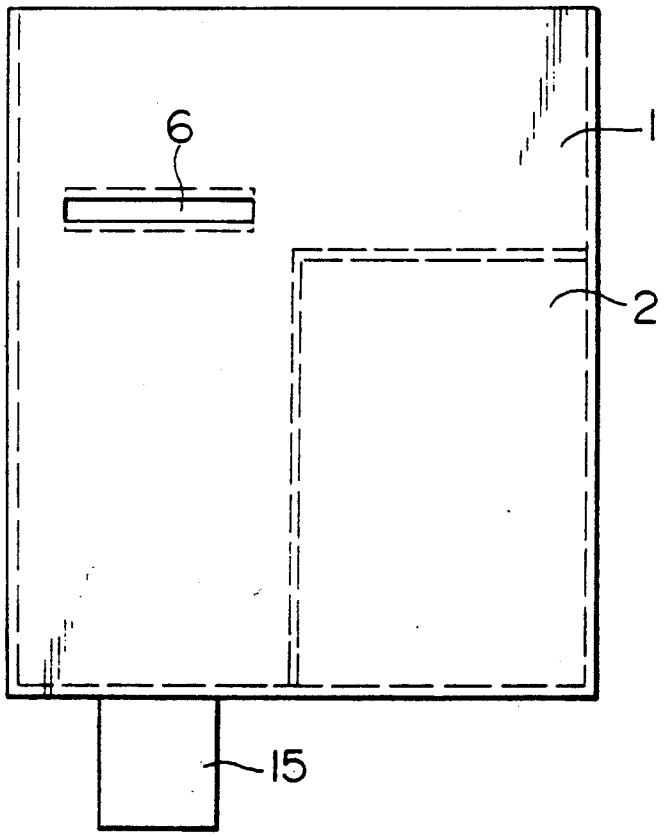
FIG. 4 is a plan view of the same.

The automatic vending machine of the present invention is described in detail below with reference to the embodiment shown in the drawings. In FIGS. 1 and 2, reference numeral 1 denotes a box body in which a stacking storage chamber 2 for articles 23 surrounded by a side wall 2*a* and a rear wall 2*b* is formed at a front position on the right side. An outlet port 4 formed with a door 5 for discharging the lowermost of the articles 23 in the stacking storage chamber 2 and a through hole 21 for a push button 15 are provided at a left upper position and at a right lower position, respectively, of the front wall 1*a* of the box body 1. An opening portion 11 is provided at a left lower position on the rear side of the stacking . storage chamber 2 so as to not inhibit the swing of a projection portion 10*a* of the discharge bar 10 (described below) which functions to push out the articles 23. Reference numerals 1*b*, 1*c*, 1*d* and 1*e* respectively denote the rear wall of the body, the right side wall thereof, an upper plate thereof having a slot 6 and the bottom plate thereof. Reference numeral 3 denotes a receiving base for the articles 23 which is provided on the bottom plate 1*f* in the stacking storage chamber 2. Reference numeral 7 denotes a coin receiving case which is pivotally provided substantially at the center thereof on a lateral pivotal shaft 8 placed over the left and right side walls 1*c*, 1*d* in a rear portion on the left side of the box body 1, with a spring 9 interposed therebetween. The coin receiving case 7 has a projection 13 which is provided lower than upper opening portion 7*a* thereof on its front side and the pushing plate 10 which has at the lower end thereof the projection portion 10*a* for pushing out the lowermost article of the articles 23 in the stacking storage chamber 2 and which is so provided as to extend downwardly from a lower opening portion 7*b*. The coin receiving case 7 is urged by the action of the spring 9 and is thus forwardly inclined from the vertical state so that the rear portion at the lower end of the pushing plate 10 is stopped in contact with the rear wall 1*b* of the box body 1 in a normal state, as shown in FIG. 1. The coin receiving case 7 is so arranged that, during this normal state, the upper opening portion 7*a* thereof which opens in the form of a trumpet is placed below the slot 6 in correspondence therewith. When coins 12 are in turn deposited through the slot 6 in the above-described state, the coins are received in the coin receiving case 7 from the upper opening portion 7*a*. A supporting plate 14 for supporting the lowermost of the coins 12 received is so provided as to project from the inner surface of the rear wall 1*b* of the box body 1. As can be seen in FIGS. 1 and 2, when four coins which represent the required number of coins are received in the coin receiving case 7, the upper half of the uppermost coin (the fourth) is substantially exposed from the receiving case 7 so as to upwardly project from the upper end opening portion 7*a* thereof. The required number of coins can be determined by correctly positioning the supporting plate 14 in the longitudinal direction. A push button 15 is engaged in a through hole 21 formed in the front wall la of the box body 1 so as to be slidable in the horizontal direction along the inner surface of a guide case in the box body 1. The push button 15 has a projecting plate 16 provided at the front end thereof and a pushing plate 17 downwardly projecting from a position behind the front end, which are respectively engaged with the uppermost coin 12 in the coin receiving case 7 and the projection 13, and both of which are integrally provided on the push button 15. Both ends of a pin 20 which is placed at the end of the push button 15 (in the lateral direction) are respectively engaged with elongated holes 19 of the guide case 18 so that the forward and backward strokes of the push button 15 and the ends of the forward and backward movement thereof are controlled. A spring 22 which has one end fixed to the projecting plate and the other end fixed to the box body 1 is also provided in such a manner that the ends of the pin 20 are respectively placed at the rear ends of the elongated holes 19 in the normal state shown by the solid lines in FIG. 1, in which the push button 15 projects to a considerable extent from the front of the box body 1. In the present invention, when the push button 15 is pressed, the projecting plate 16 firstly pushes the uppermost coin 12 so as to rotate the coin receiving case 7, thereby allowing the other coins 12 below the uppermost coin to fall down. The pushing plate 17 then further rotates the coin receiving case 7 to allow the uppermost coin 12 to fall downwardly and to allow the lowermost article 23 to be discharged.

In the present invention, therefore, in the state wherein the required number (four) of coins 12 deposited through the slot 6 are received in the coin receiving case 7, as shown by the solid line in FIG. 2, when the push button 15 is pushed to an excessive extent, the end of the projecting plate 16 firstly pushes the upper portion of the uppermost coin 12 so as to cause the coin receiving case 7 to stand erect while rotating it against the force of the spring 9. When the coin receiving case 7 is rotated to a state A shown by the dashed lines in FIG. 1 in which the coin receiving case 7 is vertical, the lowermost coin 12 supported by the supporting plate 14 is separated therefrom and thus the other three coins below the uppermost coin 12 which is still being pressed and held by the projecting plate 16 fall downward. At the same time, the pushing plate 17 which has been left from the projection 13 is brought into contact with the projection 13 of the coin receiving case 7. When the push button 15 is further pushed, the pushing plate 17 pushes the projection 13 so as to further rotate the coin receiving case 7, as well as the projecting portion **10*a* of the discharge bar 10 provided integrally with the coin receiving case 7 being forced to enter the stacking storage chamber 2 from the opening portion 11. The lowermost article 25 is consequently sent out from the outlet port with the door 5 being open. During the rotation of the coin receiving case 7, since the length of the circular arc along which the pushed portion (projection 13) is rotated by the pushing plate 17 is shorter than that of the circular arc along which pushed portion is rotated by the projecting plate 16, the projecting plate 16 is separated from the uppermost coin 12 which has been pressed thereby when the coin receiving case 7 reaches the state B shown by the dashed lines in FIG. 1, whereby the uppermost coin 12 falls down last. At the same time, the greater part of the lowermost article 23 is discharged from the outlet port 4 by the projecting portion 10*a* of the discharge bar 10, as shown in FIG. 1, whereby the article 23 can be taken out by the hand from the outside of the machine. When the push button 15 is released, the push button 15 is returned to the initial position while being moved backward owing to the restoring function of the spring 19, as well as the coin receiving case 7 being returned to the initial position shown by the solid lines in FIG. 1** while being rotated.

If the required number of coins are not received in the coin receiving case 7, the coin receiving case 7 is not rotated by pushing the push button 15, and thus the machine of course does not operate. Although the embodiment shown in the drawings concerns the case where the three coins except for the uppermost coin firstly fall and the uppermost coin then falls, the supporting plate 14 can be lengthened so as to allow all of a given number of coins to fall down at once.

What is claimed is:

1. An article-dispenser comprising;

a main body including front and rear walls, upper and lower walls and side walls, a stacking storage chamber disposed in sid main body, said chamber receiving articles stacked therein, a slot for coin mounted on said supper wall, a push button mounted slidably on said front wall, said push button being biased in a side of said front wall by a spring, a discharging opening for discharging articles out of said main body, a receiving case for receiving a predetermined number of coins in line, and having an upper opening and a lower opening, said case being mounted rotatably around a horizontal axis thereof in said main body and having a spring interposed therebetween and a projection which is mounted on an upper side thereof, a discharge bar extending downwardly from a lower end of said case for pushing a lowermost article of the articles for discharging the lowermost article out of said main body by rotating sid case, said upper opening of said case being disposed below said slot, a supporting plate having a predetermined length, extending from an inner side of said rear wall and disposed under said lower opening of said case for supporting a lowermost coin of the coins as the coins are inserted in said case, said push button having a projecting plate and a pushing plate, for engaging said projection mounted on said case so as to cause said case to rotate after said projecting plate engages an uppermost coin so as to cause said case to rotate to a predetermined angle by pushing said push button as said predetermined number of coins are inserted into said slot.

2. An article-dispenser according to claim 1, wherein said case spring biases said case towards said front wall.

3. An article-dispenser comprising;

a main body including front and rear walls, upper and lower walls and side walls, a stacking storage chamber disposed in said main body, said chamber receiving articles stacked therein, a slot for coin mounted on said upper wall, a push button mounted slidably on said front wall, said push button being biased in a side of said front wall by a spring.

* * * * *